US005292080A

United States Patent [19]

Liebing

[11] Patent Number: 5,292,080

[45] Date of Patent: Mar. 8, 1994

[54] IMPACT MILL

[75] Inventor: Stefan Liebing, Braunschweig, Fed. Rep. of Germany

[73] Assignee: Bühler GmbH, Braunschweig, Fed. Rep. of Germany

[21] Appl. No.: 803,005

[22] Filed: Dec. 4, 1991

[30] Foreign Application Priority Data

Feb. 6, 1991 [DE] Fed. Rep. of Germany ..... 4103468

[51] Int. Cl.[5] ..... B02C 19/00

[52] U.S. Cl. ..... 241/275; 241/285.3

[58] Field of Search ..... 241/275, 285.3

[56] References Cited

U.S. PATENT DOCUMENTS

| | | | |
|---|---|---|---|
| 2,352,327 | 6/1944 | Kirn | 241/275 X |
| 4,061,279 | 12/1977 | Sautter | 241/275 X |

FOREIGN PATENT DOCUMENTS

| | | | |
|---|---|---|---|
| 529396 | 7/1931 | Fed. Rep. of Germany . | |
| 1195144 | 6/1965 | Fed. Rep. of Germany . | |
| 2350220 | 4/1975 | Fed. Rep. of Germany . | |
| 3011112 | 12/1984 | Fed. Rep. of Germany . | |
| 1067760 | 6/1954 | France | 241/275 |
| 1136911 | 5/1957 | France | 241/275 |
| 289830 | 12/1970 | U.S.S.R. | 241/275 |
| 1072893 | 2/1984 | U.S.S.R. | 241/275 |
| 1080855 | 3/1984 | U.S.S.R. | 241/275 |
| 1320575 | 6/1973 | United Kingdom . | |
| 1363621 | 8/1974 | United Kingdom . | |
| 1501784 | 2/1978 | United Kingdom . | |
| 2072531 | 10/1981 | United Kingdom . | |

*Primary Examiner*—Mark Rosenbaum
*Assistant Examiner*—Frances Chin
*Attorney, Agent, or Firm*—Martin A. Farber

[57] ABSTRACT

A distribution head of an impact mill rotates about a vertical axis and throws raw material against a cylindrically-shaped impact body. The latter has a rotational axis, which forms an angle with the vertical axis to equalize the wear over the height of the impact body.

21 Claims, 1 Drawing Sheet

IMPACT MILL

FIELD OF THE INVENTION

The invention relates to an impact mill comprising a housing, a drivable distribution head rotatable about a rotational axis, and an impact body rotatable about a rotational axis arranged all around the distribution head.

BACKGROUND OF THE INVENTION

Impact mills of this type are either employed for crushing tasks or only as impact dehullers to separate brittle shells, such as the shells of soybeans or cocoa beans and of other husk fruits, or, in general terms, to separate the seeds from the kernels. In DE-C 529 396 there is disclosed an impact mill comprising a vertical driving shaft with a throwing rotor as a distribution head attached thereto. Coaxially to the driving shaft, there is arranged a cylindrically-shaped, stationary body closed at its bottom side, comprising screen sections and in-between some beaters. The distribution head includes a disk with blades on its circumference, with the disk being attached to the driving shaft in an inclined arrangement. Raw material is supplied through a drum sieve until the body, or the drum sieve is almost filled. The filling ratio is held constant during operation. Due to the particular type of this construction and the operating mode, the raw material emitted by the lower blade is not capable of exerting any impact effect upon the beaters and the drum sieve as this blade solely digs through the raw material. Thus, an impact effect is only exerted by the upper blade. As a result, the drum wall will be subjected to an irregular wearing effect.

The U.S. Pat. No. 2 352 327 discloses mill, in which both a distribution head rotatable about a vertical rotational axis and a cylindrically-shaped impact ring arranged coaxially thereto are driven, with the distribution head and the impact ring being driven with different speeds. On its bottom side, the impact ring is supported by toothed wheels meshing with said impact ring. By designing this edge region in a wavelike way, an oscillating vertical motion of the impact ring will be accomplished for realizing a uniform wear of the annular lining exchangeably fastened to the impact ring by extending the surface of the impact ring hit by the particles, which in turn will result in a longer service life. The drawbacks of this construction are to be found, on the one hand, in its higher expenses for equipment, and, on the other hand, in the difficult guidance of the impact ring within the housing, since with this construction a tilting of the ring will be highly probable. In addition, the upper and lower dead points of the wave curves will lead to a longer biasing of the impact ring at those points, thus entailing an irregular wear of the annular coating.

It is an object of the present invention to avoid the drawbacks mentioned above and to suggest an impact mill, whose impact body is subjected to a uniform wear by constructionally simple means.

SUMMARY OF THE INVENTION

This object is attained by having the two rotational axes of the distribution head and the impact body inclined relatively to each other at an angle alpha. When choosing such an arrangement, a constructionally simpler and therefore cheaper manufacture will be made possible. Also the operation of the impact mill provided by the present invention can be rendered more economical due to the regular wear of the annular coating, since the service life of the annular coating will be increased. At any rate, the jet of the particles emitted by the distribution head will stroke over different surface regions of the impact body when this is being rotated, so that the wear is distributed over all these parts.

When the two rotational axes are to form an angle with each other, only one of the two axes may lie on a vertical plane, if so. However, it is preferred to choose an arrangement in which the rotational axis of the distribution head extends in vertical direction, with the discharge openings of the distribution head preferably lying on a horizontal plane. In principle, it would be possible to readjust the impact body by a particular sector of an angle by hand from time to time. However, it will be more advantageous to design the impact body as a drivable unit with the help of a driving system, preferably equipped with a reduction gear unit.

Within the scope of the invention, quite a great sector of an angle between the two rotational axes would be conceivable, particulary if the impact body itself is not exactly cylindrical, but is, for example, spherically bulged. However, it is more convenient to limit the angle alpha, which is formed by the two rotational axes, to an amount of 20°, but preferably to about 15°.

BRIEF DESCRIPTION OF THE DRAWING

Other details of the invention will result from the following description of an embodiment schematically shown in merely one drawing illustrating a vertical section through an impact mill as provided by the present invention.

DETAILED DESCRIPTION OF THE DRAWING

Figure 1:
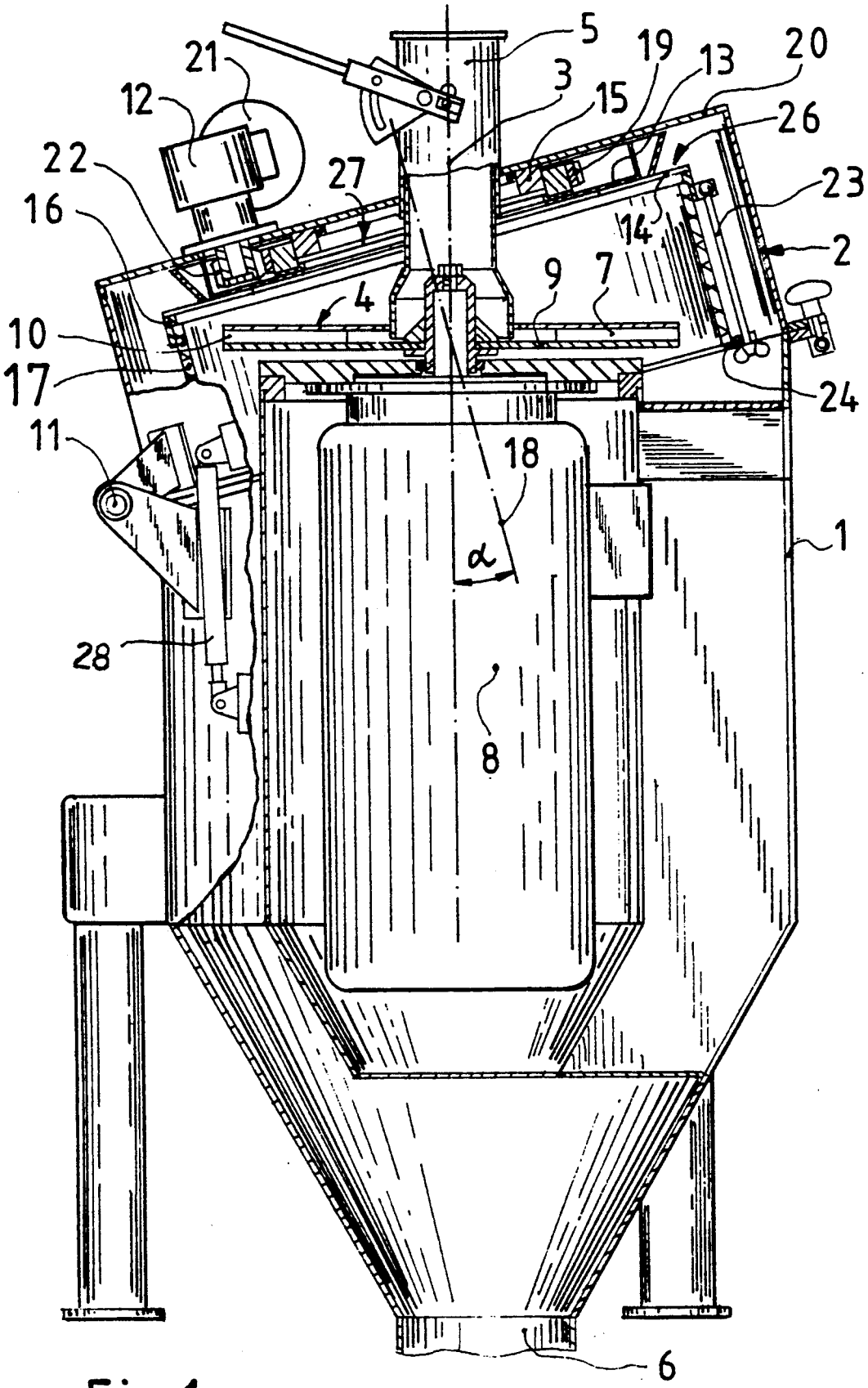

The impact mill comprises a cylindrical housing 1 which can be shut by a lid 2 attached thereto about a pivot 11 in a swingable, or swivable way, respectively. The rotational axis 3 of a distribution head 4 arranged in the housing runs centrically through an upper feeding pipe 5 for the raw material, through housing 1, and through a lower discharge pipe 6. The distribution head 4, which can be driven from underneath by a driving motor 8 enclosed by a metallic sheathing, is rotatably fixed in housing 1, and includes a disk 9 extending horizontally, with radial or curved blades 7 extending upwards from it. The construction of the distribution head can be varied in any possible way within the scope of the invention. For example, instead of employing only one disk, two tubular centrifugal arms arranged on both sides of rotational axis 3 may be provided. In each case, the discharge openings 10 of the distribution head 4 will lie on a horizontal plane.

In lid 2 a mounting 16 for an impact body 17 is rotatably arranged, the rotational axis 18 of which impact body being inclined relatively to the rotational axis 3 when lid 2 is closed, in such a manner that the two rotational axes 3, 18 intersect each other at an angle alpha. The angle alpha has a value of typically 15° ± 2° and a maximum value of 20°. It is advantageous to design the intersecting point of the two rotational axes 3, 18 on the level of distribution head 4, as illustrated, because in such a manner the distances of the discharge openings of distribution head 4 from impact ring 17 will vary merely within a relatively small distance range when the impact ring 17 is turning relatively to distribution head 4. The angle formed by the two axes 3, 18 depends on the diameter of disk 9 and on the height and diameter of impact ring 17, as well as possibly also on its shape (cylindrical or curved). Of course, the impact body may also be constituted of straight metal plates, if necessary provided with a rubber lining, which metal plates are arranged all around rotational axis 3 in a stationary or movable way. Examples for such impact bodies are disclosed, for instance, in DE-B-1 195 144, in DE-A-23 50 220 or in DE-C-30 11 112, the entire disclosures of which are incorporated herein by reference. It is advantageous to provide a counter-move member, or damping element 28, respectively, in order to compensate for the weight of the lid.

In order to support the rotatable impact body on lid 2, an upper bearing body 15 is to be provided on the latter, which bearing body 15 is attached to lid 2, whereas the distribution head 4 is preferably firmly connected to the stationary part of the housing. Of course, it is also possible to fasten distribution head 1 to lid 2. In this case, the distribution head 4 could be swung onto a driving cone of motor 8 when lid 2 is hinged down so as to accomplish the driving connection. The feeding pipe 5 may also be firmly connected to lid 2. Another possibility arises when first the feeding pipe 5 is detached when lid 2 is swung open.

It is advantageous to drive the mounting 16 with the impact ring 17 as well, however, with a smaller rotational speed. To this end, a gear rim 19 is arranged coaxially to rotational axis 18 in between mounting 16, against which the impact ring 17 is clamped, and an end cap 20 of lid 2. The gear rim 19 engages a pinion 22 driven by a geared motor 21 with reduction gear unit 12, mounted on the outside of end cap 20. Of course, it would also be conceivable to provide a V-belt drive, or any other driving method, but in any case it will be advantageous to design the respective drive wheel gear rim 19 with a central opening 27, through which the raw material can be supplied; in this case this will take place via feeding pipe 5. To keep the latter in as vertical a position as possible, it is convenient to make opening 27 encompass both rotational axes 3, 18 at a certain distance from them. If necessary, also a ratchet mechanism for the turn of impact ring 17 may be used. In this way, the problem of supply of material will be solved in a simple manner, in spite of diverging rotational axes.

From the drawing it will be apparent that the left part of disk 9 is directed to a section of the upper edge of impact ring 17, and the right part of disk 9 to a section of the lower part of ring 17. In between the left and right parts, disk 9 faces the central portions of the impact ring. With just a small rotational speed of impact body 17, for example two revolutions per minute, all the sections of all height levels of impact body 17 will be impacted in a uniform way.

In order to prevent dead corners from developing (at the top on the left in the drawing), in which impacted material may settle, it is preferred to provide clearances 26 in mounting 16 in the marginal area next to impact ring 17, so that the raw material can pass upwards and thereafter, outside the impact wall 17, to discharge pipe 6. To connect gear rim 19 to impact wall 17, the former is firmly linked to a disk 13, which in turn is connected to mounting 16 by a small web 14 leaving open the openings 26. For a detachable fastening of impact wall 17 to disk 13, there is provided a closing member 23 extending into a clamping ring 24 attached to impact wall 17.

Within the scope of the invention, numerous modifications are conceivable; for example, if impact rings of varying heights (possibly also of varying shapes) for different raw materials are to be employed, it may be desirable to make the angle alpha changeable. This may be done by rendering lid 2 with housing 1 adjustable in its height via an adjusting spindle, or by designing it with a plurality of selectively usable catches for the closed position, with any possible gap in between housing 1 and lid 2 being covered by a telescopically displaceable intermediate part connected to the housing or the lid.

What is claimed is:

1. Apparatus for impacting a granular material, such as grains, seeds comprising housing means having a distribution head mounted therein for rotation about a longitudinal axis;

said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member;

rotating means for rotating said impact member around the central axis of said impact member and around said distribution head;

wherein said housing means further comprises lid means and a pivot, said lid means being pivotable about said pivot between an open position and a closed position for enabling access to said distribution head; and bearing means for rotatably supporting said impact member on said lid means;

wherein said supply means comprises tubing means passing through an opening in said lid means, said opening being larger in diameter than said tubing means to permit a pivoting of said lid means while said tubing means is stationary;

wherein the longitudinal axis of said distribution head and said central axis of said impact member form an angle with each other; and said impact member is spaced apart from said supply means allowing said supply means to remain stationary independent of rotation of said impact member, said impact member comprising an annular wall and an upper wall means shutting the upper side of said annular wall at least in part, but leaving at least one clearance adjacent to said annular wall bypassing said bearing means for enabling said material to pass through.

2. Apparatus as claimed in claim 1, wherein said longitudinal axis is vertical.

3. Apparatus as claimed in claim 1, wherein said at least one channel is situated on a horizontal plane.

4. Apparatus as claimed in claim 1, wherein said rotating means comprise motor means.

5. Apparatus as claimed in claim 4, wherein said rotating means comprise reduction gear means.

6. Apparatus as claimed in claim 1, wherein said angle amounts to 20° in maximum.

7. Apparatus as claimed in claim 6, wherein said angle amounts to 15° ± 2°.

8. Apparatus as claimed in claim 1, wherein said lid means is arranged at the top side of the housing means 9. Apparatus as claimed in claim 8, wherein said distribution head is stationarily supported by said housing-means.

10. Apparatus as claimed in claim 8, further comprising impact member holding means and a gear rim, both being supported by said bearing means, and pinion means engaging said gear rim.

11. Apparatus as claimed in claim 1, wherein said rotating means comprise gear means having a central opening, said supply means projecting through said opening.

12. Apparatus as claimed in claim 11, wherein said gear means surrounds said axes at a predetermined distance.

13. Apparatus as claimed in claim 1, wherein said upper wall forms at least two clearances separated by a relatively small web.

14. Apparatus as claimed in claim 1, wherein said axes intersect each other on the level of said distribution head.

15. Apparatus as claimed in claim 1, wherein said supply means comprises a feeding pipe disposed coaxially to said distribution head.

16. Apparatus for impacting a granular material, such as grains, seeds, comprising housing means having a distribution head mounted therein for rotation about a longitudinal axis;

said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member, said impact member being spaced apart from said supply means allowing said supply means to remain stationary independent of rotation of said impact member;

rotating means for rotating said impact member around the central axis of said impact member and around said distribution head;

wherein the longitudinal axis of said distribution head and said central axis of said impact member form an angle with each other;

wherein said housing means further comprises lid means being movable between an open position and a closed position for enabling access to said distribution head, said lid means being arranged at the top side of the housing means; and bearing means for rotatably supporting said impact member on said lid means wherein said supply means comprises tubing means passing through an opening in said lid means, said opening being larger in diameter than said tubing means to permit a pivoting of said lid means while said tubing means is stationary; and wherein passages are provided by said at least one clearance above said impact member for discharge of said granular material, there being a space bypassing said bearing means between said annular wall of said impact member and said lid means for receiving granular material discharged via said passages.

17. Apparatus for impacting a granular material, such as grains, seeds, comprising housing means having a distribution head mounted therein for rotation about a longitudinal axis, said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member, said impact member being spaced apart from said supply means allowing said supply means to remain stationary independent of rotation of said impact member;

rotating means for rotating said impact member around the central axis of said impact member and around said distribution head;

wherein the longitudinal axis of said distribution head and said central axis of said impact member form an angle with each other;

said rotating means comprise motor means; and said rotating means comprise gear means having a central opening, said supply means projecting through said opening;

wherein said housing means further comprises lid means and a pivot, said lid means being pivotable about said pivot between an open position and a closed position for enabling access to said distribution head; and bearing means for rotatably supporting said impact member on said lid means;

wherein said supply means comprises tubing means passing through an opening in said lid means, said opening being larger in diameter than said tubing means to permit a pivoting of said lid means while said tubing means is stationary; and passages are provided by said at least one clearance above said impact member for discharge of said granular material, there being a space bypassing said bearing means between said annular wall of said impact member and said lid means for receiving granular material discharged via said passages.

18. Apparatus for impacting a granular material, such as grains, seeds, comprising housing means having a distribution head mounted therein for rotation about a longitudinal axis, said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member;

rotating means for rotating said impact member around the central axis of said impact member and around said distribution head, said rotating means comprising gear means having a central opening, said supply means projecting through said opening;

wherein the longitudinal axis of said distribution head and said central axis of said impact member form an angle with each other; and said impact member comprises an annular wall and un upper wall means shutting the upper side of said annular wall at least in part, but leaving at least one clearance adjacent to said annular wall for enabling said material to pass through;

wherein said housing means further comprises lid means and a pivot, said lid means being pivotable about said pivot between an open position and a closed position for enabling access to said distribution head; and bearing means for rotatably supporting said impact member on said lid means;

wherein said supply means comprises tubing means passing through an opening in said lid means, said opening being larger in diameter than said tubing means to permit a pivoting of said lid means while said tubing means is stationary; and passages are provided by said at least one clearance above said impact member for discharge of said granular material, there being a space bypassing said bearing means between said annular wall of said impact member and said lid means for receiving granular material discharged via said passages.

19. Apparatus for impacting a granular material, such as grains, seeds, comprising housing means having a distribution head mounted therein for rotation about a longitudinal axis, said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member;

rotating mans for rotating said impact member around the central axis of said impact member and around said distribution head;

wherein the longitudinal axis of said distribution head and said central axis of said impact member form an angle with each other; and said impact member is spaced apart from said supply means allowing said supply means to remain stationary independent of rotation of said impact member, said impact member comprising an annular wall and an upper wall means shutting the upper side of said annular wall at least in part, but leaving at least on clearance adjacent to said annular wall for enabling said material to pass through;

wherein said housing means further comprise lid means being movable between an open position and a closed position for enabling access to said distribution head, said lid means being arranged at the top side of the housing means; and bearing means for rotatably supporting said impact member on said lid means;

wherein said supply means comprises tubing means passing through an opening in said lid means, said opening being larger in diameter than said tubing means to permit a pivoting of said lid means while said tubing means is stationary;

wherein said apparatus further comprises impact member holding means and a gear rim, both being supported by said bearing means, and pinion means engaging said gear rim;

said rotating means comprise motor means;

said motor means engages with said pinion means and is supported by said lid means; and passages are provided by said at least one clearance above said impact member for discharge of said granular material, there being a space bypassing said bearing means between said annular wall of said impact member and said lid for receiving granular material via said passage.

20. Apparatus for impacting a granular material, including grains and seeds, comprising housing means having a distribution head mounted therein for rotation about a longitudinal axis, said distribution head having wall means forming at least one radially extending channel;

drive means for rotating said distribution head;

a ring-shaped impact member surrounding said distribution head and having a central axis;

supply means arranged for supplying said granular material to said distribution head within a central region of the distribution head located at said longitudinal axis, so that the granular material being under the action of centrifugal force enters said at least one channel to be impacted against said impact member;

rotating means for rotating said impact member around the central axis of said impact member and around said distribution head;

wherein the longitudinal axis of said distribution head and said central axis of said impact member are angled to each other; and said impact member is spaced apart from said supply means allowing said supply means to remain stationary independent of rotation of said impact member, said impact member comprising an annular wall and an upper wall means shutting the upper side of said annular wall at least in part, but leaving at least one clearance adjacent to said annular wall for enabling said material to pass through;

wherein said housing means further comprises lid means and a pivot, said lid means being pivotable about said pivot between an open position and a closed position for enabling access to said distribution head; and bearing means for rotatably supporting said impact member on said lid means;

wherein said supply means comprises tubing means passing through an opening in said lid means, said opening being larger in diameter than said tubing means to permit a pivoting of said lid means while said tubing means is stationary; and passages are provided by said at least one clearance above said impact member for discharge of said granular material, there being a space bypassing said bearing means between said annular wall of said impact member and said lid means means for receiving granular material discharged via said passages.

21. Apparatus according to claim 20, wherein said rotating means includes motor means supported by said lid means.

* * * * *